US007040880B2

(12) United States Patent
Hasegawa et al.

(10) Patent No.: US 7,040,880 B2
(45) Date of Patent: May 9, 2006

(54) HORIZONTAL ROTARY COMPRESSOR

(75) Inventors: Masumi Hasegawa, Fuji (JP); Toshimasa Aoki, Shizuoka (JP); Shinya Gotou, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 11/043,166

(22) Filed: Jan. 27, 2005

(65) Prior Publication Data

US 2005/0129559 A1 Jun. 16, 2005

Related U.S. Application Data

(63) Continuation of application No. PCT/JP03/09205, filed on Jul. 18, 2003.

(30) Foreign Application Priority Data

Jul. 29, 2002 (JP) ..... 2002-220247

(51) Int. Cl.
*F03C 2/00* (2006.01)
*F04C 29/02* (2006.01)
*F04C 18/00* (2006.01)

(52) U.S. Cl. ..... 418/60; 418/63; 418/88; 418/96; 418/270; 184/6.16

(58) Field of Classification Search ..... 418/60, 418/63, 88, 96–98, 270; 184/6.16
See application file for complete search history.

(56) References Cited

U.S. PATENT DOCUMENTS 4,543,046 A 9/1985 Hasegawa
4,543,047 A 9/1985 Hasegawa
4,557,677 A 12/1985 Hasegawa
4,645,429 A * 2/1987 Asami et al. ..... 418/94
4,759,698 A 7/1988 Nissen
4,781,542 A * 11/1988 Ozu et al. ..... 418/88
5,012,896 A * 5/1991 Da Costa ..... 184/6.16
5,222,885 A * 6/1993 Cooksey ..... 418/94
5,322,420 A 6/1994 Yannascoli
5,345,785 A * 9/1994 Sekigami et al. ..... 418/96

FOREIGN PATENT DOCUMENTS

JP 56-154592 11/1981
JP 60-230590 11/1985
JP 61-80385 5/1986
JP 02019689 A * 1/1990
JP 2-81994 3/1990
JP 06074179 A * 3/1994
JP 7-83182 3/1995
JP 7-217576 8/1995

* cited by examiner

*Primary Examiner*—Theresa Trieu
(74) *Attorney, Agent, or Firm*—Finnegan, Henderson, Farabow, Garrett & Dunner, L.L.P.

(57) ABSTRACT

A horizontal rotary compressor is configured such that an electrically powered compressor body is accommodated in a horizontally long hermetic receptacle in which a lubricating oil is accumulatively preserved, an interior of the hermetic receptacle is partitioned by a partition member into an oil storage portion space in which the compressor mechanism portion is positioned and an electric motor side space in which the electric motor portion is positioned, an oil communication portion is provided below the partition member, a gas communication opening is provided in an upper portion of the partition member, and an oil feed passageway is formed of a center opening, an oil guide opening, and oil suction tubing along the rotation axis.

4 Claims, 3 Drawing Sheets

HORIZONTAL ROTARY COMPRESSOR

CROSS REFERENCE TO RELATED APPLICATIONS

This is a Continuation Application of PCT Application No. PCT/JP03/09205, filed Jul. 18, 2003, which was published under PCT Article 21(2) in Japanese.

This application is based upon and claims the benefit of priority from prior Japanese Patent Application No. 2002-220247, filed Jul. 29, 2002, the entire contents of which are incorporated herein by reference.

BACKGROUND OF THE INVENTION

1. Field of the Invention

The present invention relates to a horizontal rotary compressor that serves to constitute a refrigeration cycle of any one of, for example, refrigerating units and air-conditioning units.

2. Description of the Related Art

While various types of compressors are used with, for example, refrigerating units and air-conditioning units, among those being popularly used are rotary compressors that have high reliability and produce low operating noise.

Among those mostly accounting for regular types are vertically-installed types that can be installed using less installation space. However, cases occur where horizontally-installed type rotary compressors are used depending on conditions of, for example, disposition thereof together with other refrigeration cycle components and other special conditions.

In a compressor of the above-described type, an electrically powered compressor body with a horizontal axial direction is accommodated in a horizontally long hermetic receptacle. The electrically powered compressor body is formed to include a rotary compressor mechanism portion provided in one end portion of a rotation axis supported through bearings, and an electric motor portion provided in the other end portion.

Lubricating oil is accumulatively preserved in the hermetic receptacle. In line with rotation of a rotation axis, the lubricating oil is drawn out and fed to individual sliding portions constituting the compressor mechanism portion.

For example, Jpn. UM Appln. KOKOKU Publication No. 61-80385 has a description regarding an oil feed structure in a horizontal rotary compressor, wherein an oil filler for communication with a cylinder chamber is provided in a plate of a compressor mechanism portion. As such, lubricating oil can be drawn out by using a pressure difference between the pressure in the cylinder chamber and the pressure in a hermetic receptacle and can be fed to desired lubrication requiring portions.

However, according to the lubrication structure described above, when the oil level in an oil draw-in portion falls in the event of, for example, operation of the compressor in a tilted state, sufficient drawing-in cannot be achieved, thereby causing insufficient oil feed to the individual sliding portions. In addition, even in a state where the differential pressure between high pressure and low pressure is low, oil feed becomes insufficient, thereby causing a low-reliability problem.

BRIEF SUMMARY OF THE INVENTION

An object of the present invention is to provide a horizontal rotary compressor that ensures oil feed to individual sliding portions of a compressor mechanism portion, thereby enabling high reliability to be obtained.

A horizontal rotary compressor of the present invention is configured such that an electrically powered compressor body comprising of a rotation axis supported through bearings to be horizontally rotatable, a rotary compressor mechanism portion provided in one end portion of the rotation axis, and an electric motor portion provided in the other end portion of the rotation axis is accommodated in a horizontally long hermetic receptacle wherein a lubricating oil is accumulatively preserved in an inner bottom portion; an interior of the hermetic receptacle is partitioned by a partition member into an oil storage portion space wherein the compressor mechanism portion is positioned and an electric motor side space wherein the electric motor portion is positioned; an oil communication portion that communicates between the oil storage portion space and the electric motor side space thereby to guide the lubricating oil in the side of the oil storage portion space to the electric motor side space is provided below the partition member; a gas communication opening that guides to the oil storage portion space high-pressure gases compressed in the compressor mechanism portion and discharged to the electric motor side space is provided in an upper portion of the partition member and; and an oil feed passageway is formed of a center opening provided along an axial center from one end face of the rotation axis, an oil guide opening for communicating between the center opening and individual sliding portions of the compressor mechanism portion, and oil suction tubing provided between an opening end of a rotation axis end face of the center opening and an inner portion of the lubricating oil in the oil storage portion space. The lubricating oil in the oil storage portion space is drawn up by using a pressure difference between pressures in the oil storage portion space and in the center opening, and is fed to the individual sliding portions of the compressor mechanism portion.

According to the present invention, advantages are exhibited in that, in the horizontal rotary compressor, oil feed to the individual sliding portions of the compressor mechanism portion can be securely implemented, and high reliability can be obtained.

DETAILED DESCRIPTION OF THE INVENTION

Figure 1:
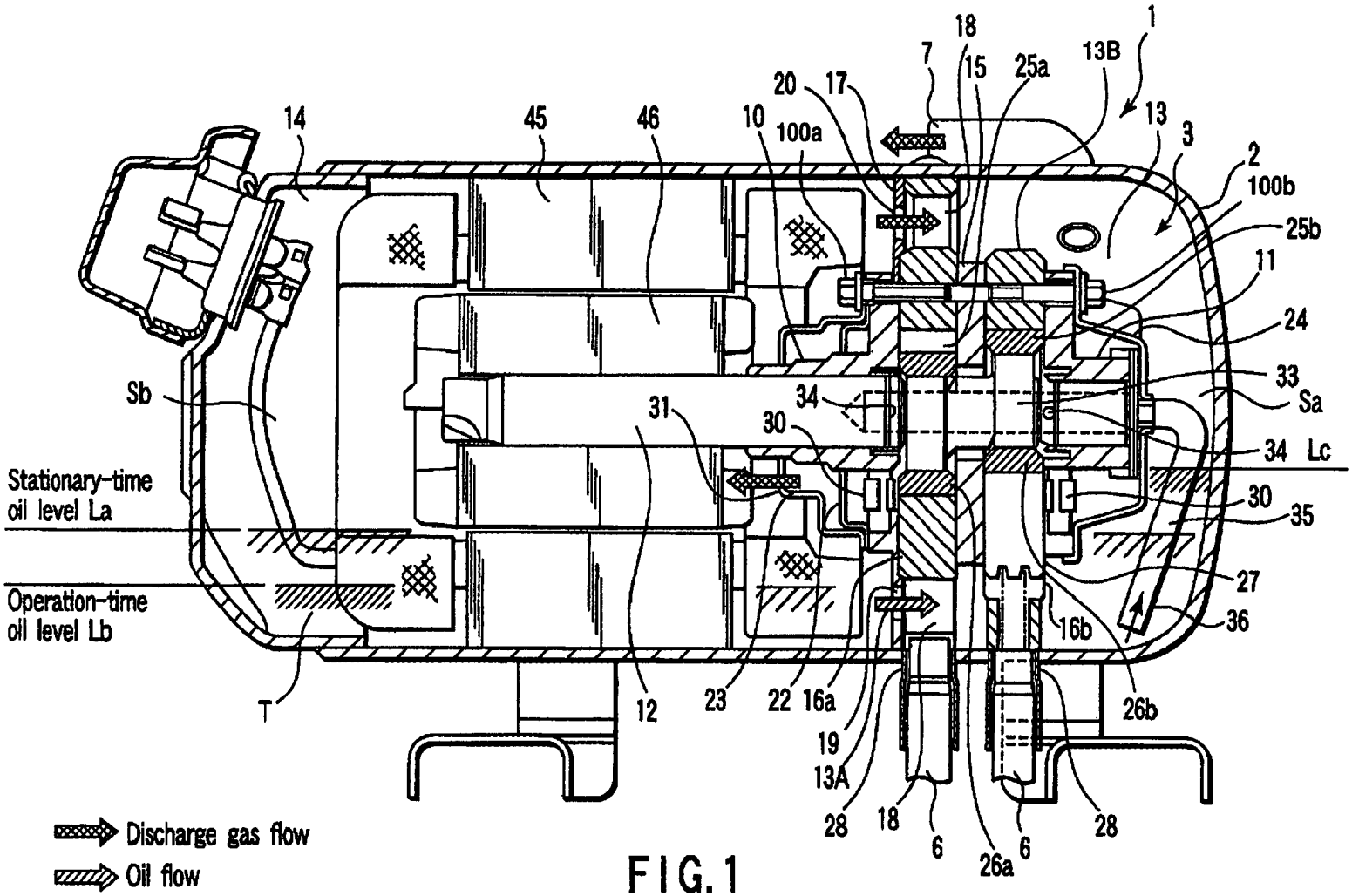
FIG. 1 is a cross-sectional front view of a horizontal rotary compressor according to an embodiment of the present invention.
Figure 2:
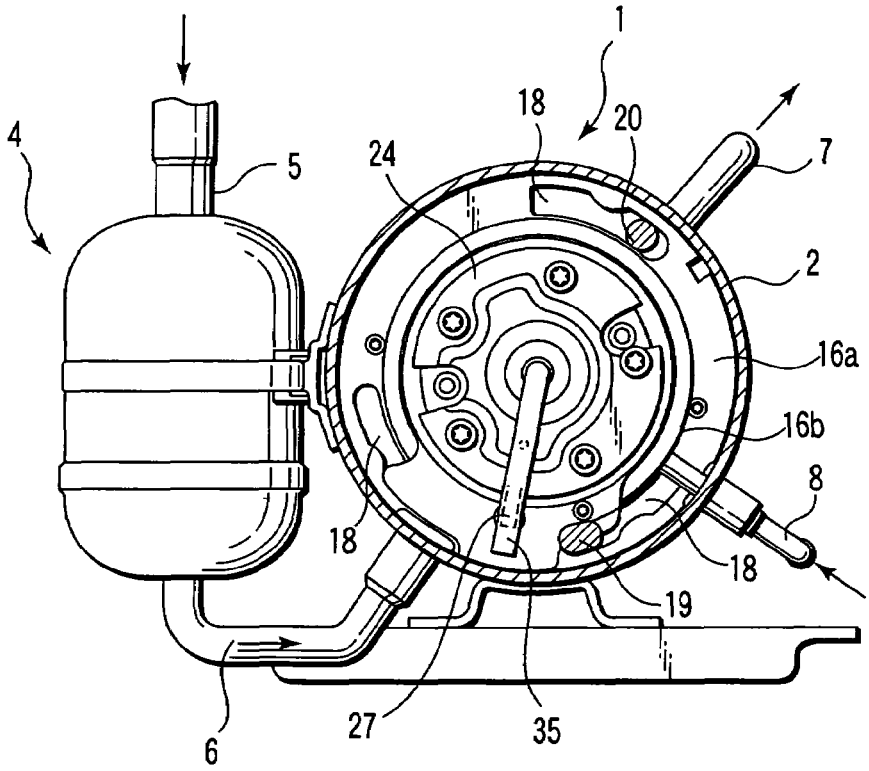
FIG. 2 is a cross-sectional side view of the horizontal rotary compressor.

FIG. 1 is a cross-sectional front view of a horizontal rotary compressor; and FIG. 2 is a cross-sectional side view of the compressor.

In the drawing, 1 denotes the horizontal rotary compressor configured such that an electrically powered compressor body 3 is accommodated in a hermetic receptacle 2 as described hereinafter. In the drawing figure, 4 denotes an accumulator, an upper end portion of which is connected to refrigerant tubing 5 that communicates with an evaporator (not shown) that serves to constitute a refrigeration cycle.

An lower end portion of the accumulator 4 and a lower portion of the hermetic receptacle 2 of the horizontal rotary compressor 1 are coupled by means of suction tubing 6 in communication with each other. There is provided a two-cylinder type compressor mechanism portion, wherein two pieces of suction tubing 6 are connected in an overlapped state, as shown in FIG. 2.

Discharge refrigerant tubing 7 is connected in a position symmetric with the suction tubing 6 in the hermetic receptacle 2. An end portion of the discharge refrigerant tubing 7 is opened. The discharge refrigerant tubing 7 is coupled in communication with a condenser constituting the refrigeration cycle.

In addition, as shown only in FIG. 2, injection tubing 8 is provided protruding in an oblique right downward direction from the hermetic receptacle 2. The tubing is branched from a refrigerant derivation side of the condenser, thereby to directly guide part of liquid refrigerant by necessity to the horizontal rotary compressor 1.

The electrically powered compressor body 3 is accommodated in the hermetic receptacle 2, and is configured by the following components. They are a rotation axis 12 rotatably supported in the horizontal direction through a primary bearing 10 and a secondary bearing 11; a rotary compressor mechanism portion 13 provided in a right portion in the drawing figure, which is one end portion of the rotation axis 12; and an electric motor portion 14 provided in a left portion in the drawing figure, which is then the other end portion of the rotation axis 12.

The rotary compressor mechanism portion 13 is configured by a first compressor mechanism portion 13A and a second compressor mechanism portion 13B that are provided both left and right sides of an intermediate partition plate 15. The first compressor mechanism portion 13A is located in the side of the electric motor portion 14, which corresponds to the on the left side of the intermediate partition plate 15. The second compressor mechanism portion 13B is located on the opposite side of the electric motor portion, which corresponds to the right side of the intermediate partition plate 15.

The respective compressor mechanism portions 13A and 13B have cylinders 16*a* and 16*b*. The cylinder 16*a* of the first compressor mechanism portion 13A has an outer diameter substantially identical to an inside diameter of the hermetic receptacle 2, and is mounted in the hermetic receptacle in an engagement state.

A plate-like partition member 17 is mounted on a sidewall in the side of the electric motor portion 14 and peripheral end portion of the cylinder 16*a*. Thus, the interior of the hermetic receptacle 2 is partitioned into the left and right sides by the cylinder 16*a* of the first compressor mechanism portion 13A and the partition member 17.

With respect to the cylinder 16*a* and partition member 17 being contemplated as a boundary, one side of the interior of the hermetic receptacle 2 is referred to as an "oil storage portion space Sa" wherein the compressor mechanism portion 13 is positioned, and the other side thereof is referred to as a "electric motor side space Sb" wherein the electric motor portion 14 is positioned.

Figure 3:
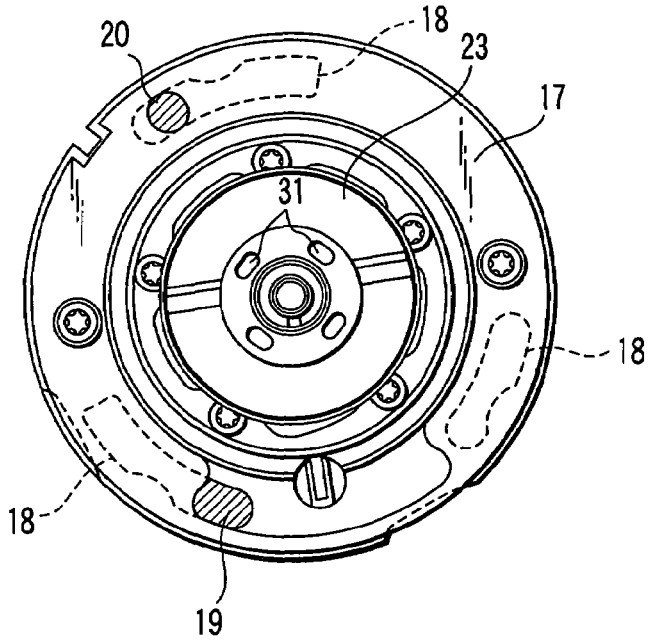
FIG. 3 is a cross-sectional side view of the horizontal rotary compressor.
Figure 4:
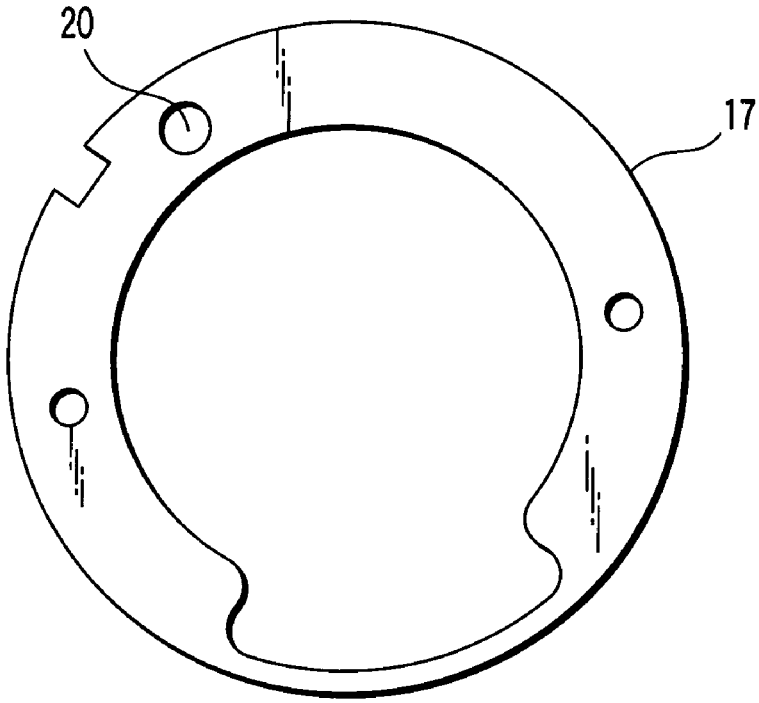
FIG. 4 is a front view of a partition member built into the horizontal rotary compressor.

FIG. 3 is a cross-sectional side view of the horizontal rotary compressor in the side of the partition member 17, as viewed from the electric motor side space Sb; and FIG. 4 is a front view of the partition member 17.

The cylinder 16*a* is a cast product, and a plurality of circular arc casting-out portions 18 are provided in a peripheral portion of the cylinder. A lower portion of the partition member 17 is cut out in a trapezoidal shape, and an oil communication opening 19 is formed from a position of assembly with the casting-out portion 18.

In addition, a gas communication opening 20 in communication with the casting-out portion 18 on an upper portion side of the cylinder 16*a* is provided in an upper portion of the partition member 17. A connection position of the discharge refrigerant tubing 7 in the hermetic receptacle 2 is preferably selectively set to a position higher than the position of the gas communication opening 20 and at a ⅔ or higher level of the overall height of the hermetic receptacle.

Consequently, the above setting makes it difficult for the lubricating oil to overflow from the compressor 1 through the discharge refrigerant tubing 7. This enables all-time securing of a reservoir amount of the lubricant oil, and concurrently enabling effective use of the oil storage portion space Sa.

On one sidewall of the cylinder 16*a* of the first compressor mechanism portion 13A, the primary bearing 10 is in contact with an axis center portion, and the intermediate partition plate 15 is in contact with the other sidewall. The outer diameter of the cylinder 16*b* of the second compressor mechanism portion 13B is much smaller than the outer diameter of the cylinder 16*a* of the first compressor mechanism portion 13A. A portion of the cylinder 16*b* outwardly protrudes, and a peripheral surface thereof is in contact with the inner circumferential surface of the hermetic receptacle 2.

The intermediate partition plate 15 is in contact with one sidewall of the cylinder 16*b* of the second compressor mechanism portion 13B, and the secondary bearing 11 is in contact with the other sidewall thereof. The primary and secondary bearings 10 and 11, the two cylinders 16*a* and 16*b*, and the intermediate partition plate 15 are integrally engageably secured by means of fixtures 100*a* and 100*b* screwed from both sides.

In addition, by means of the fixtures 100*a* and 100*b*, a first discharge cover 22 and a valve cover 23 are mounted on the primary bearing 10, and a second discharge cover 24 is mounted on the secondary bearing 11.

Inner opening portions of the respective cylinders 16*a* and 16*b* are formed as cylinder chambers 25*a* and 25*b* in a manner that both left and right sides are surrounded by the respective primary and secondary bearings 10 and 11 and the intermediate partition plate 15. In portions of the rotation axis 12 opposing the respective cylinder chambers 25*a* and 25*b*, eccentric rollers 26*a* and 26*b* are fitted into the cylinder chambers to be eccentrically rotatable.

Although only the second compressor mechanism portion 13B is shown, a top edge of a blade 27 is in contact with a peripheral surface of the roller 26*b* in a state where the blade 27 is elastically urged thereagainst, whereby the cylinder chambers 25*a* and 25*b* are each partitioned into a high-pressure side and a low-pressure side.

Two pieces of the suction tubing 6 in communication with the accumulator 4 are passed through the hermetic receptacle 2, and are inserted and secured to a mounting opening 28 provided in a hermetic-receptacle engagement portion of each of the cylinders 16*a* and 16*b*. The mounting opening 28 is open in each cylinder chamber 25*a*, 25*b*, so that the suction tubing 6 directly communicates with the cylinder chamber.

Discharge valve mechanisms 30 in communication with the cylinder chambers 25*a* and 25*b* are provided in the primary bearing 10 and the secondary bearing 11. The first discharge cover 22 mounted on the primary bearing 10 covers the discharge valve mechanism 30 of the primary bearing, and the second discharge cover 24 covers the discharge valve mechanism 30 of the secondary bearing.

The first discharge cover 22 has a gas guide opening by which to guide gases passed therethrough into the valve cover 23. Such a gas guide opening is not specifically provided in the second discharge cover 24.

In lieu of the above, although not shown, a gas guide passageway may communicate with the cylinder 16*b* through the cylinder 16*a* and the intermediate partition plate 15. Gases to be discharged into the second discharge cover 24 are guided into the first discharge cover 22 through the above-described gas guide passageway.

More specifically, a gas compressed in a first cylinder chamber 25*a* and a gas compressed in a second cylinder chamber 25*b* are merged with each other and made to flow into the first discharge cover 22. Thereby, merged gases are guided into the valve cover 23 from the gas guide opening of the first discharge cover 22.

A gas opening 31 is provided in the valve cover 23, and the merged gases are led to flow therethrough and are discharged and guided into the hermetic receptacle 2. Since the valve cover 23 is provided protruding into the electric motor side space Sb, gas to be discharged through the gas opening 31 fills the electric motor side space Sb.

From the end face of the rotation axis 12 on the secondary bearing 11 side to an opposing portion of the primary bearing 10, an oil feed center opening 33 is provided along a central axis thereof. There is provided an oil guide opening 34 for communication between a middle portion of the oil feed center opening 33 and the respective inner portions of the eccentric rollers 26*a* and 26*b* in the first and second cylinder chambers 25*a* and 25*b*.

An end-face opening portion of the rotation axis 12 of the oil feed center opening 33 is closed by the second discharge cover 24, and the oil feed center opening 33 is formed into a hermetic structure. Oil suction tubing 35 is connected to the second discharge cover 24, wherein one opening end opposes the oil feed center opening 33.

The other end portion of the oil suction tubing 35 is immersed in the lubricating oil in an oil basin portion T formed below the hermetic receptacle 2. Therefore, an oil feed passageway 36 is formed of the oil feed center opening 33 and the oil guide opening 34 from the oil suction tubing 35, whereby individual sliding portions of the first and second compressor mechanism portions 13A and 13B are communicated to the oil basin portion T.

Figure 5A:
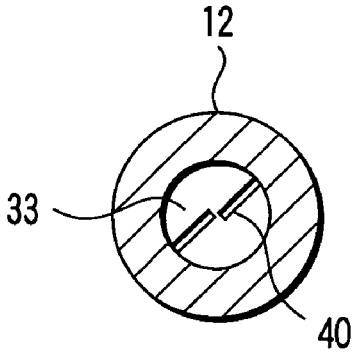
FIGS. 5A and 5B, respectively, are a front view and a side view of a twist pump built into the horizontal rotary compressor.
Figure 5B:
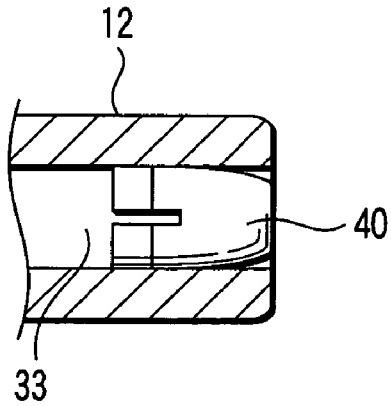

As shown in FIGS. 5A and 5B, a pump member, such as a twist pump 40, is preferably provided in the oil feed center opening 33 on the end portion side of the rotation axis 12. The twist pump 40 is formed such that a cutout is formed in a plate piece from one end portion thereof, and both sides of the plate piece are misaligned with each other. Thereby, when the rotation axis 12 rotates, an effective centrifugal force can be imparted to the lubricating oil in the oil feed center opening 33.

The electric motor portion 14 is formed of a stator 45 secured to the inner surface of the hermetic receptacle 2, and a rotor 46 which is disposed via a predetermined spacing to the inner side of the stator and into which the rotation axis 12 is inserted.

In the horizontal rotary compressor configured as described above, upon electrical conduction to the electric motor portion 14, the rotation axis 12 is rotated, and evaporated refrigerant gases are guided from the refrigeration cycle to the compressor 1 through the accumulator 4 and two pieces of the suction tubing 6.

In the respective cylinder chambers 25*a* and 25*b* of the first and second the compressor mechanism portions 13A and 13B, the eccentric rollers 26*a* and 26*b* are eccentrically rotating, whereby the refrigerant gases are introduced into the respective cylinder chambers and compressed.

The gases compressed and highly pressurized are discharged into the respective first and second discharge covers 22 and 24. Subsequently, the overall high-pressure gases temporarily fill the valve cover 23, wherein muffling effects are obtained; and the gases are discharged to the electric motor side space Sb through the gas opening 31.

The high-pressure gases fill the electric motor side space Sb, and are subsequently guided to the oil storage portion space Sa through the gas communication opening 20 of the partition member 17 and the casting-out portions 18 of the first cylinder 16*a*. The high-pressure gases filling the oil storage portion space Sa are discharged from the discharge refrigerant tubing 7 and guided to the condenser, thereby serving to constitute the refrigeration cycle.

The high-pressure gases discharged to the electric motor side space Sb from the individual compressor mechanism portions 13A and 13B are contaminated with the lubricating oil having lubricated the individual compressor mechanism portions 13A and 13B. The lubricating oil in the high-pressure gases is separated from the high-pressure gases in the electric motor side space Sb and the oil storage portion spaces Sa. Concurrently, the gases are effectively separated by being impinged on irregular cast surfaces of the casting-out portions 18. Thereby, the amount of the lubricating oil to be discharged from the discharge refrigerant tubing 7 can be reduced. In addition, oil separation effects can be enhanced in the manner that the gas communication opening 20 of the partition member 17 is formed by a cut-and-raising process, and the high-pressure gases are forcedly led to impinge on the cast surfaces of the casting-out portions 18.

In the oil basin portion T formed on a bottom portion of the hermetic receptacle 2, the oil storage portion space Sa and the electric motor side space Sb are put in the state of communication with each other by means of the oil communication opening 19 and the casting-out portions 18 formed below the partition member 17 and the first cylinder 16*a*.

As shown in FIG. 1, heights La of the oil level in the oil basin portion T at a static time or at an operation-stopped state are the same in the oil storage portion space Sa and the electric motor side space Sb. When operation is resumed and continued, the high-pressure gases discharged from the valve cover 23 fill the electric motor side space Sb, so that the electric motor side space is placed under a condition where the pressure is higher than that in the oil storage portion space Sa.

The oil storage portion space Sa is filled with the high-pressure gases introduced through the gas communication opening 20 of the partition member 17 and the casting-out portions 18 of the first cylinder. Concurrently, the gas is discharged from the discharge refrigerant tubing 7. Consequently, the space is placed under a condition where the pressure is lower than that in the electric motor side space Sb.

Therefore, at an operation time, the oil level is low (Lb) in the electric motor side space Sb, but the oil level is higher (Lc) than the level in the oil storage portion space Sa. In this state, the rotor 46 constituting the electric motor portion 14 is located at a higher position than the oil-level height Lb. Consequently, the rotor is not rotated while dispersing the lubricating oil, and hence energy loss can be prevented.

While the oil-level height Lc is increased in the oil storage portion space Sa, in line with the eccentric rotation of the eccentric rollers 26*a* and 26*b*, the cylinder chambers 25*a* and 25*b* are each partitioned by the blade 27 into a high-pressure chamber and a low-pressure chamber.

The pressures in inner portions of the eccentric rollers 26*a* and 26*b* of the cylinder chambers 25*a* and 25*b* each become an intermediate pressure. Concurrently, also the pressure at the oil feed center opening 33 for communication through the oil guide opening 34 becomes an intermediate pressure. Consequently, there occurs a pressure difference in the oil feed center opening 33 and the oil storage portion space Sa.

Accordingly, the lubricating oil filling the lower portion of the oil storage portion space Sa is drawn up through the oil suction tubing 35. The lubricating oil is guided from the oil suction tubing 35 to the oil feed center opening 33, and is further guided to the inner portions of the respective eccentric rollers 26*a* and 26*b* of the cylinder chambers 25*a* and 25*b* through the oil guide opening 34.

Thus, the lubricating oil is guided from the oil basin portion T along the oil feed passageway 36, and is securely fed to the individual sliding portions that constitute the first and second compressor mechanism portions 13A and 13B. Consequently, sufficient lubricity in the individual sliding portions is ensured.

In the embodiment described above, the outer diameter of the cylinder 16*a* of the first compressor mechanism portion 13A is set identical with the inner diameter of the hermetic receptacle 2, and the partition member 17 is mounted on the sidewall portion opposing the electric motor side space Sb. However, the embodiment is not limited thereto.

For example, the arrangement may be such that in lieu of use of the small-diameter cylinder 16*a* of the first compressor mechanism portion 13A, the plate thickness of the partition member 17 is sufficiently increased, and only the partition member may be used to partition the interior of the hermetic receptacle 2 into the left and right sides. Alternatively, the cylinder 16*a* may be shared as being the partition member.

In addition, according to the embodiment described above, the high-pressure gases compressed in the individual first and second the compressor mechanism portions 13A and 13B and discharged are temporarily accepted in the valve cover 23 to thereby damp noise. Thereafter, the gases are discharged into the hermetic receptacle 2 through the gas opening 31.

In this connection, the area of the gas opening 31 provided in the valve cover 23 is represented by "Ao", and the area of the gas communication opening 20 provided in the partition member 17 is represented by "A1". In this case, Ao is set larger than A1 (Ao>A1).

Conversely, suppose that the area A1 is larger than Ao. In this case, in the event that the amount of refrigerant circulation is small, differential pressure between the pressures in the electric motor side space Sb and the oil storage portion space Sa is not caused. Subsequently, the oil level in the oil storage portion space does not rise, so that oil feed becomes insufficient and reliability is decreased.

Concurrently, the oil level in the electric motor side space Sb is raised to the extent of causing defects such as friction losses resulting from the event that the oil level touches the rotor 46 that constitutes the electric motor portion 14.

Therefore, the area (A1) of the gas communication opening 20 is set as: area (Ao) of the gas opening 31 of the valve cover 23>area (A1) of the gas communication opening 20 of the partition member 17, whereby, while the amount of refrigerant circulation is small, the setting makes it possible to secure the differential pressure between the pressures in the electric motor side space Sb and the oil storage portion space Sa. The setting enables raising the oil level in the oil storage portion space, and enables sufficient oil feed to enhance reliability. Concurrently, no such event occurs in which the oil level in the electric motor side space is all-time lowered, and the oil level touches the rotor 46 of the electric motor portion.

In addition, the area (A1) of the gas communication opening 20 of the partition member 17 is set equal to or larger than ½ of the area (Ao) of the gas opening 31 of the valve cover 23 (A1≧Ao/2).

Conversely, suppose that the area (A1) of the gas communication opening 20 of the partition member 17 is set smaller than ½ of the area (Ao) of the gas opening 31 of the valve cover 23. In this case, in the event of a large amount of refrigerant circulation, the differential pressure between the pressures in the electric motor side space Sb and the oil storage portion space Sa is very high. Thereby, the oil level of the oil storage portion space is excessively raised, whereby the lubricant oil may overflow from the discharge refrigerant tubing 7.

For these reasons, the area (A1) of the gas communication opening 20 is preferably set such that the area (A1) of the gas communication opening 20 of the partition member 17 is equal to or larger than ½ of the area (Ao) of the gas opening 31 of the valve cover 23 (A1≧Ao/2).

In this case, the partition member 17 is preferably mounted not to be in contact with the blade 27 that constitutes the compressor mechanism portion 13. Consequently, a spacing is formed between the partition member 17 and the blade 27.

Substantially the entirety of the blade 27 is in the state where it is immersed in the lubricating oil having the oil level being raised, and the spacing formed with the partition member 17 is secured. Thereby, the lubricating oil is securely guided, and lubricity of the blade 27 can be secured.

According to the present invention, oil feed to individual sliding portions of a compressor mechanism portion can be securely achieved, and a horizontal rotary compressor having high reliability can be obtained.

What is claimed is:

1. A horizontal rotary compressor comprising:

a horizontally long hermetic receptacle in which a lubricating oil is accumulatively preserved in an inner bottom portion;

an electrically powered compressor body comprising a rotation axis which is accommodated in the hermetic receptacle and which is supported through bearings to be horizontally rotatable, a rotary compressor mechanism portion provided in one end portion of the rotation axis, and an electric motor portion provided in the other end portion of the rotation axis;

a partition member which partitions an interior of the hermetic receptacle into left and right sides, and one side is used as an oil storage portion space in which the compressor mechanism portion is positioned and the other side is used as an electric motor side space in which the electric motor portion is positioned;

an oil communication opening which is provided below the partition member and which communicates between the oil storage portion space and the electric motor side space, thereby to guide the lubrication oil in the side of the electric motor space to the oil storage portion space;

a gas communication opening which is provided in an upper portion of the partition member and which guides to the oil storage portion space high-pressure gases compressed in the compressor mechanism portion and discharged to the electric motor side space; and a valve cover which temporarily accepts high-pressure gases compressed in the compressor mechanism portion and discharged, damps noise, and discharges the gases into the hermetic receptacle through a gas opening, wherein an area (Ao) of the gas opening of the valve cover is larger than an area (A1) of the gas communication opening of the partition member (Ao>A1).

2. A horizontal rotary compressor according to claim 1, wherein the area (A1) of the gas communication opening of the partition member is not smaller than ½ of the area (Ao) of the gas opening of the valve cover (A1≧Ao/2).

3. A horizontal rotary compressor according to claim 1, wherein the partition member is formed of a cast cylinder constituting the compressor mechanism portion, and the oil communication opening and the gas communication opening are casting-out portions formed in cast forming.

4. A horizontal rotary compressor according to claim 1, wherein the partition member is mounted not to be in contact with a blade constituting the compressor mechanism portion.

* * * * *